US007836977B2

(12) United States Patent
Head

(10) Patent No.: US 7,836,977 B2
(45) Date of Patent: Nov. 23, 2010

(54) METHOD OF DRILLING A WELL AT OR UNDER BALANCE USING A ELECTRICAL SUBMERSIBLE PUMP

(76) Inventor: Philip Head, Turbogenset House, Heathrow Summit Centre, Skyport Drive, West Drayton (GB) UB7 OLJ ( * ) Notice: Subject to any disclaimer, the term of this patent is extended or adjusted under 35 U.S.C. 154(b) by 265 days.

(21) Appl. No.: 11/661,301

(22) PCT Filed: Aug. 15, 2005

(86) PCT No.: PCT/GB2005/003191

§ 371 (c)(1),
(2), (4) Date: Apr. 13, 2009

(87) PCT Pub. No.: WO2006/021750

PCT Pub. Date: Mar. 2, 2006

(65) Prior Publication Data

US 2009/0200078 A1 Aug. 13, 2009

(30) Foreign Application Priority Data

Aug. 27, 2004 (GB) ..... 0419193.8

(51) Int. Cl.
*E21B 21/00* (2006.01)

(52) U.S. Cl. ..... 175/324; 175/257

(58) Field of Classification Search ..... 175/324, 175/257, 318

See application file for complete search history.

(56) References Cited

U.S. PATENT DOCUMENTS

| | | | | |
|---|---|---|---|---|
| 2,984,310 | A * | 5/1961 | Meier | 175/98 |
| 3,185,225 | A * | 5/1965 | Ginies | 175/94 |
| 4,463,814 | A * | 8/1984 | Horstmeyer et al. | 175/45 |
| 5,645,132 | A * | 7/1997 | Åsberg | 175/318 |
| 2004/0134662 | A1 * | 7/2004 | Chitwood et al. | 166/367 |

* cited by examiner

*Primary Examiner*—Hoang Dang
(74) *Attorney, Agent, or Firm*—Andrew Wilford

(57) ABSTRACT

A drilling system for use in a well bore consists of a drill string, an electrically powerable pump (8), a connector (16) for supporting the pump (8) including a through bore (32) through which fluid can flow, and a power cable (15) to provide power to the electrically powerable pump. The cuttings are pumped up through the drillpipe (3). The drill bit (4) may also be powered by the pump. Part of the cable is disposed externally to the drill string where new pipe sections are added, before passing into the drill string through a crossover means (40) further down the drillpipe to connect to the electrically powerable pump.

8 Claims, 8 Drawing Sheets

METHOD OF DRILLING A WELL AT OR UNDER BALANCE USING A ELECTRICAL SUBMERSIBLE PUMP

CROSS REFERENCE TO RELATED APPLICATIONS

This application is the US national phase of PCT application PCT/GB2005/003191, filed 15 Aug. 2005, published 2 Mar. 2006 as WO 2006/021750, and claiming the priority of British patent application 0419193.8 itself filed 27 Aug. 2004.

The present invention relates to a method of drilling a borehole into a subterranean hydrocarbon-bearing formation using a drill string with a electrically operated drilling device.

In conventional methods of wellbore drilling a drill string including a drill bit at its lower end is rotated in the wellbore while drilling fluid is pumped through a longitudinal passage in the drill string, which drilling fluid returns to surface via the annular space between the drill string and the wellbore wall. When drilling through an earth layer not containing a fluid, the weight and the pumping rate of the drilling fluid are selected so that the pressure at the wellbore wall is kept between a lower level at which the wellbore becomes unstable and an upper level at which the wellbore wall is fractured. When the wellbore is drilled through a hydrocarbon fluid containing zone the drilling fluid pressure should moreover be above the pressure at which hydrocarbon fluid starts flowing into the wellbore, and below the pressure at which undesired invasion of drilling fluid into the formation occurs. These requirements impose certain restrictions to the drilling process, and particularly to the length of the wellbore intervals at which casing is to be installed in the wellbore. For example, if the drilling fluid pressure at the wellbore bottom is just below the upper limit at which undesired drilling fluid invasion into the formation occurs, the drilling fluid pressure at the top of the open-hole wellbore interval can be close to the lower limit at which hydrocarbon fluid influx occurs. The maximum allowable length of the open-hole interval depends on the specific weight of the drilling fluid, the hydrocarbon fluid pressure in the formation, and the height of the drilling fluid column.

Furthermore, it has been practiced to drill through a hydrocarbon fluid bearing zone at wellbore pressures below the formation fluid pressure, a methodology commonly referred to as under-balanced drilling. During under-balanced drilling hydrocarbon fluid flows into the wellbore, and consequently the drilling equipment at surface has to be designed to handle such inflow. Moreover, special measures must be taken to control the fluid pressure in the wellbore during the drilling process.

It is an objective of this invention to provide a drilling system where the problems of controlling the fluid pressure in the wellbore are reduced. Another objective of this invention is to ease the constraints upon the maximum allowable length of open hole.

It is a further objective of the present invention to reduce damage to the open hole. It is a further objective of the present invention to provide broadband telemetry to the bit, obtain real time drilling assembly diagnostics, monitor the motor current to optimize the thrust on the bit to achieve optimum drilling rate without stalling the bit.

According to the present invention there is provided a 1. A drilling system for use in a well bore consisting of a drill string, an electrically powerable pump, a connector for supporting the pump including a through bore through which fluid can flow, and a power cable to provide power to the electrically powerable pump.

The cable is for the majority of the well inside the drillpipe, until new joints of pipe have to be added at surface, at this point an electrical power cross over sub is installed to allow the internal cable to be electrically connected to the external electrical cable which is then strapped to the outside of the drillpipe. At the cross over tool the internal electrical connection is made in such a way that the internal electrical components can be retrieved and replaced, without having to remove the drillpipe or casing from the well. At surface, two options exist, one is if the drillpipe does not rotate, then the wire can be stored on a simple reel assembly, and the wireline spooled off and strapped to the drillpipe, as new drillpipe is added. However, if the drillpipe has to be rotated, the wireline reel is stored on a drum and is mounted on a frame which mounts itself to the drill pipe and is maintained with electrical power via a slip ring assembly and high voltage wet connect.

This allows a well to be drilled whilst circulating the drilling fluids back up the inside of the drillpipe (reverse to conventional drilling) using a down hole electrically powered pump. By feeding clean fluids into the annulus, lower flow rate reduces damage to the open hole, expose the open hole to no drill cuttings, fluid level can be controlled to provide fine tuning of the dynamic pressure at the drilling bit face. Eliminate the logistic issues for $N_2$ tanks and pumps used with conventional under balance drilling The invention will now be described, by way of example, and with reference to drawings of which;

FIG. 1. shows a cross section through a well being constructed with drill pipe installed to its total depth. (Adjacent to the well is a cable and electrical submersible pump (ESP) assembly which will be run inside the drill pipe.

Figure 1:
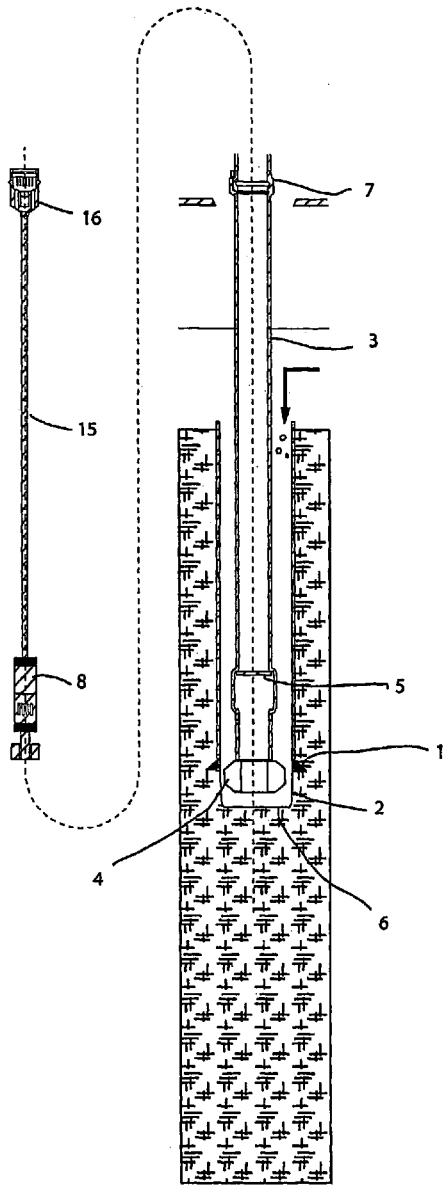
Figure 2:
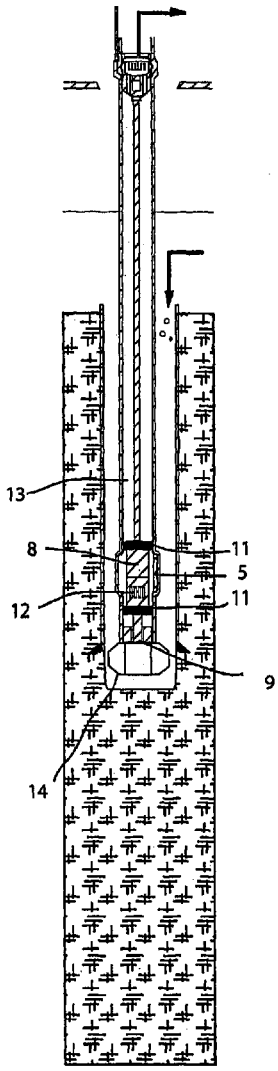
FIG. 2 shows the same cross section as FIG. 1, but with the ESP installed inside the drillpipe.
Figure 3:
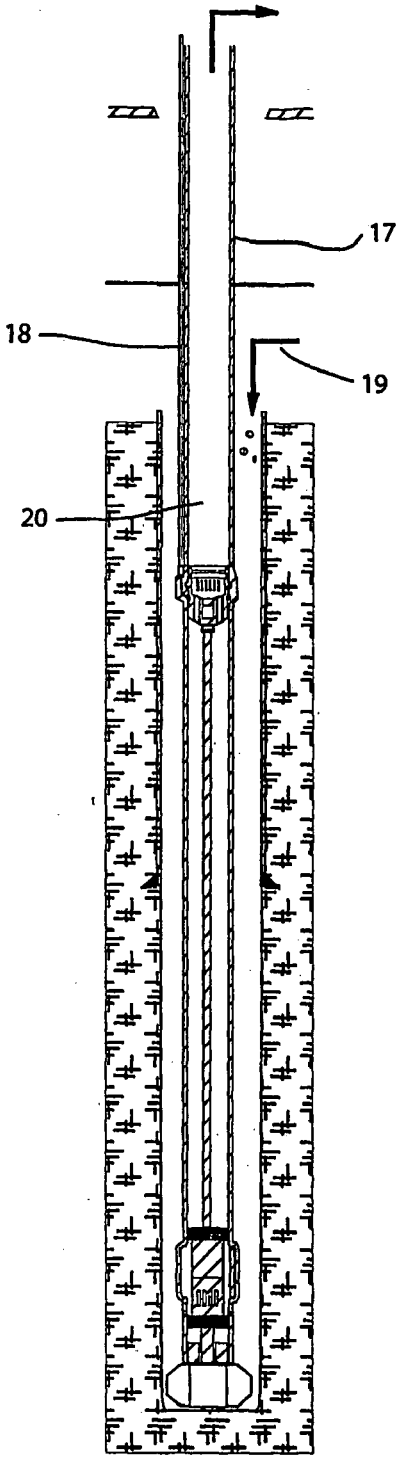
FIG. 3 shows the same cross section as FIG. 2, but with the addition of new drillpipe and an electrical cable strapped to the outside of the new added drillpipe.
Figure 4:
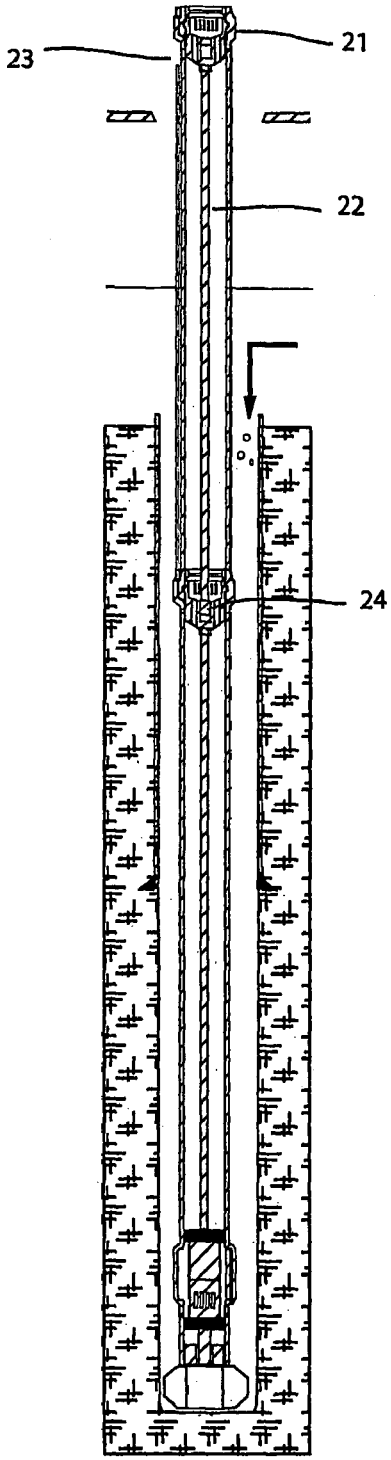
FIG. 4 shows the same view as FIG. 3, but with an internal extension to the electrical cable going back to surface, which overrides or disables the externally strapped cable.
Figure 5:
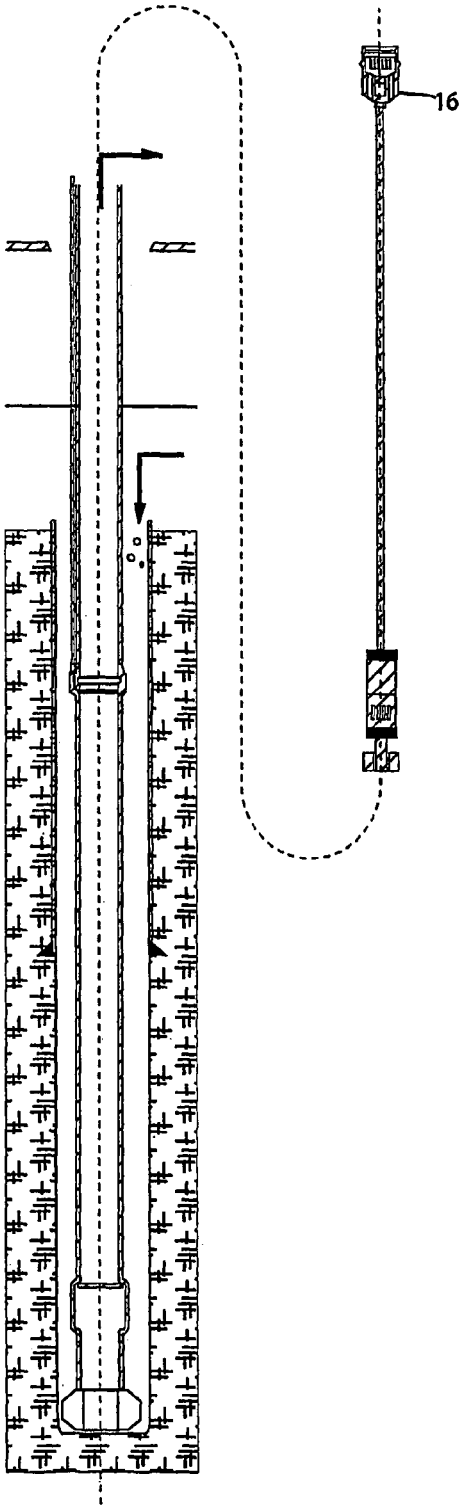

FIG. 5. Shows the same view as FIG. 4, with the internal esp and cable removed from the drillpipe.

Figure 6:
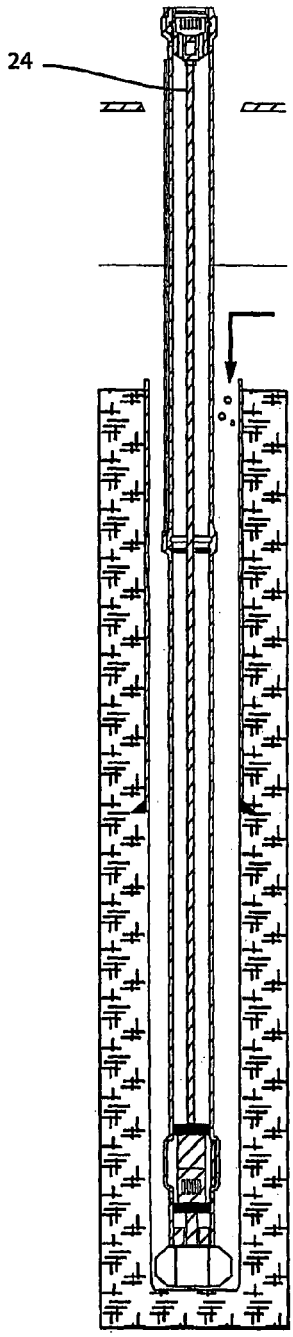

FIG. 6. shows the same view as FIG. 5, with a new ESP assembly installed and landed in a new electrical cross over tool at surface.

Figure 7:
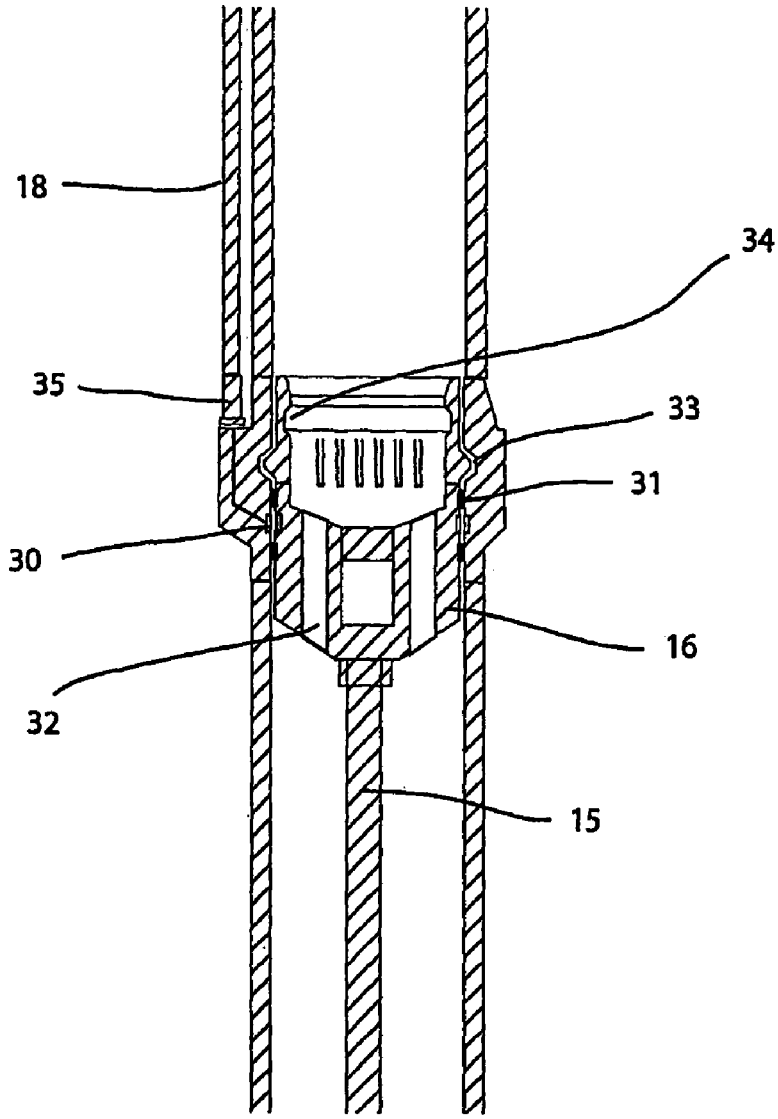

FIG. 7. Shows a cross section through the electrical cross over tool.

Figure 8:
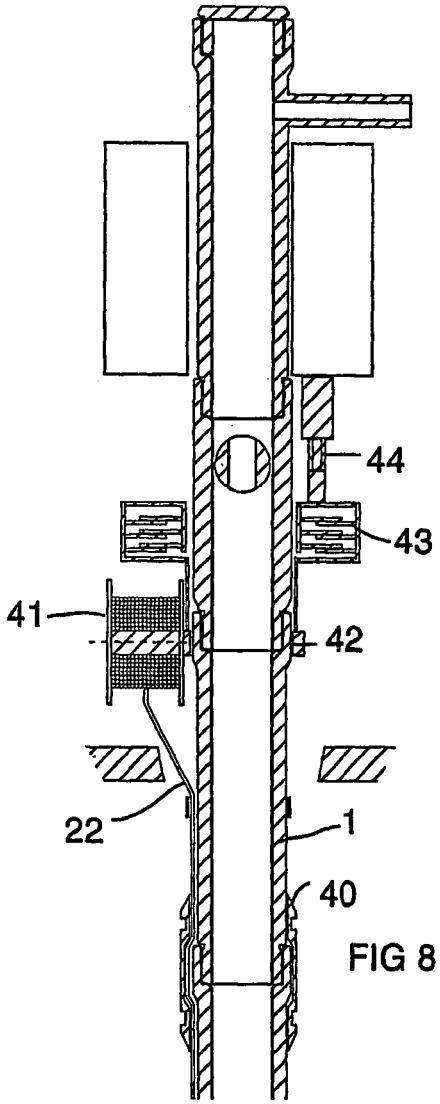
Figure 9:
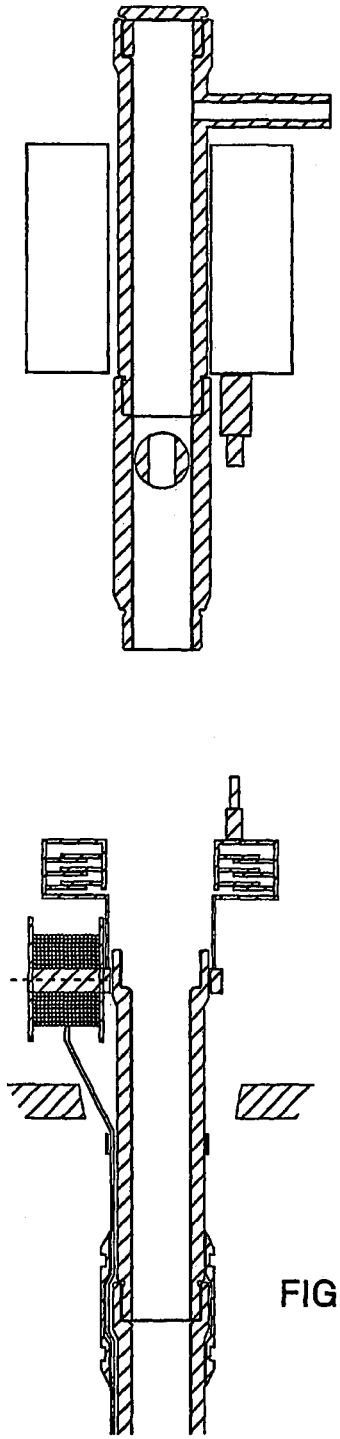
Figure 10:
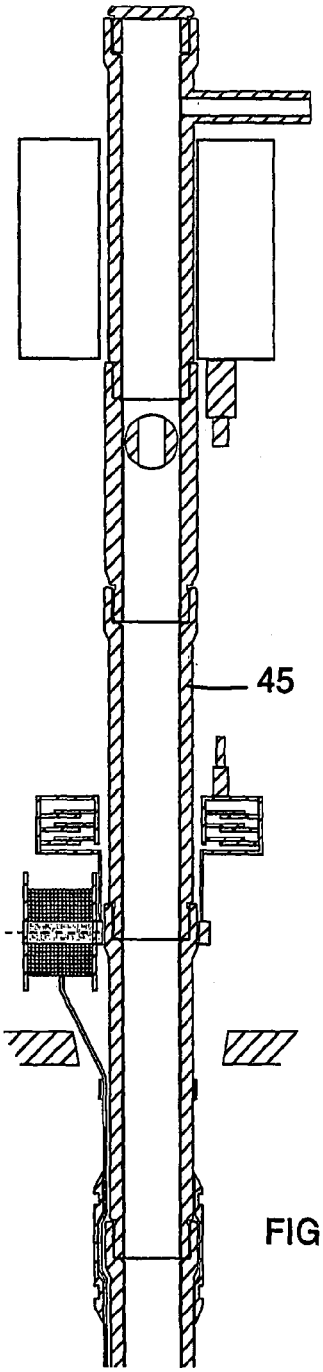
Figure 11:
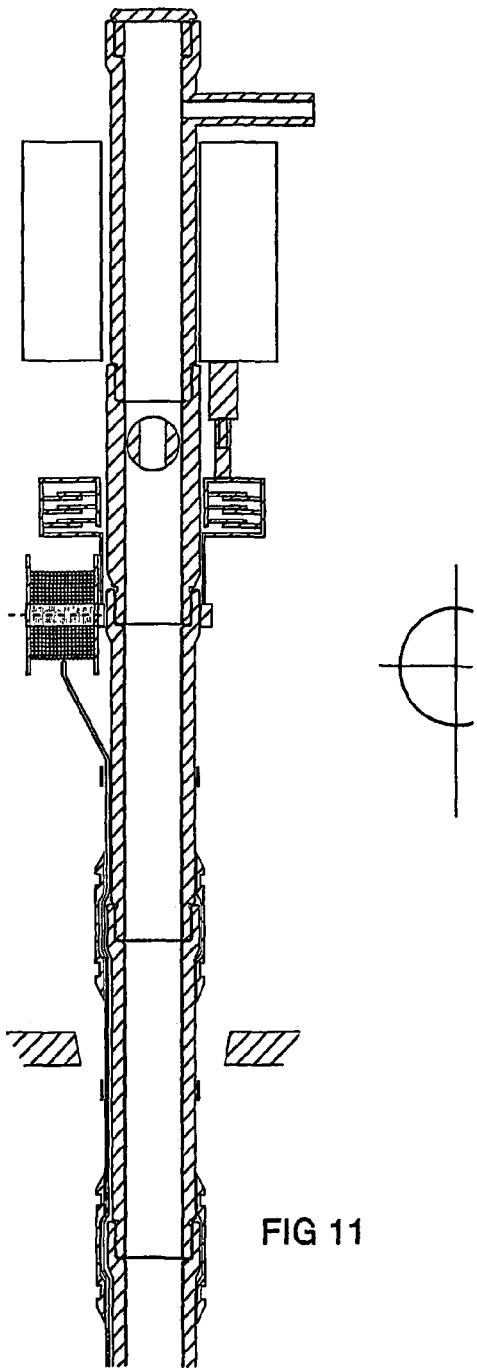

FIG. 8 is a cross section side view of the rig hardware just prior to adding a new joint of drillpipe FIG. 9 is a cross section side view of the rig hardware with the top drive disconnected so as to add a new joint of pipe FIG. 10 is a cross section side view of the rig hardware with a new joint of drillpipe added FIG. 11 is a cross section side view of the rig hardware with a new joint of drillpipe added and the wireline reel, slip ring assembly and wet connect winched up and docked in its operating position.

Figure 12:
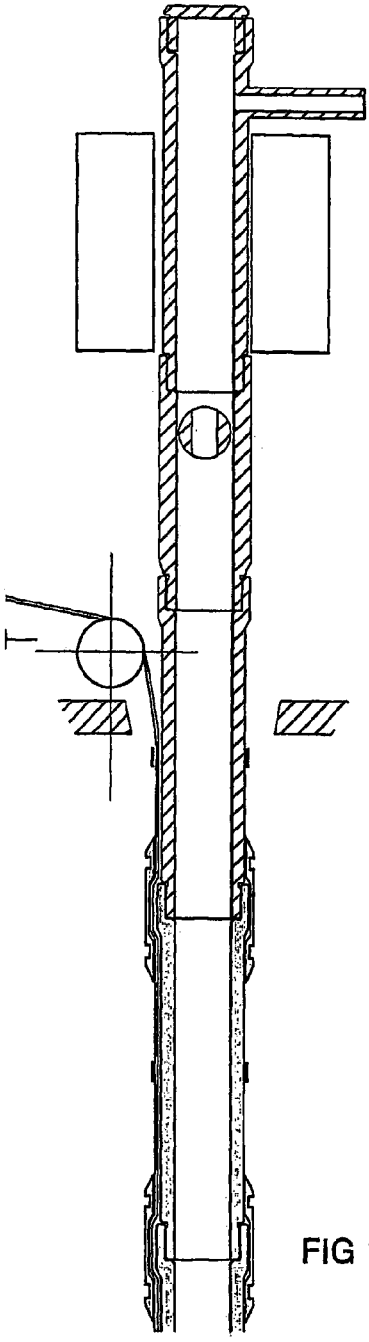
Figure 13:
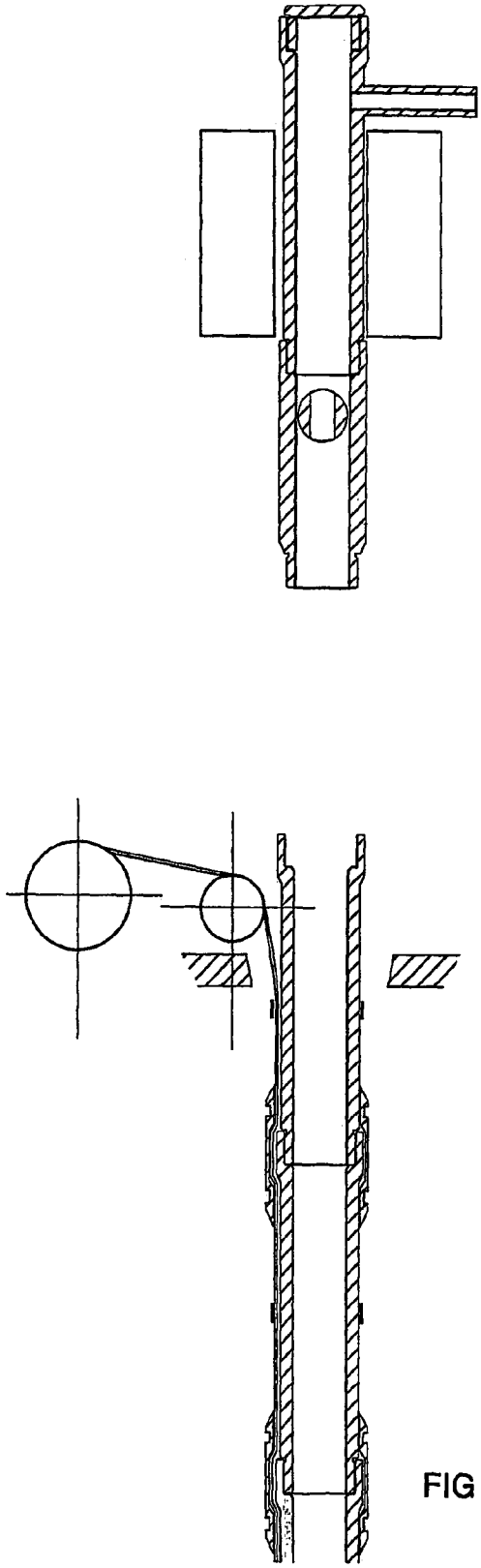

FIG. 12 is a cross section side view of the rig hardware with the wireline reel to one side of the rig floor, the drillpipe in this option does not rotate so the new wire is just spooled off and added as the drillpipe is lowered into the well FIG. 13 is a cross section side view of the rig hardware with the wireline reel to one side of the rig floor, the drillpipe in this option does not rotate so the new wire is just spooled off and added as the drillpipe is lowered into the well. The top drive has been disconnected to add a new joint.

Figure 14:
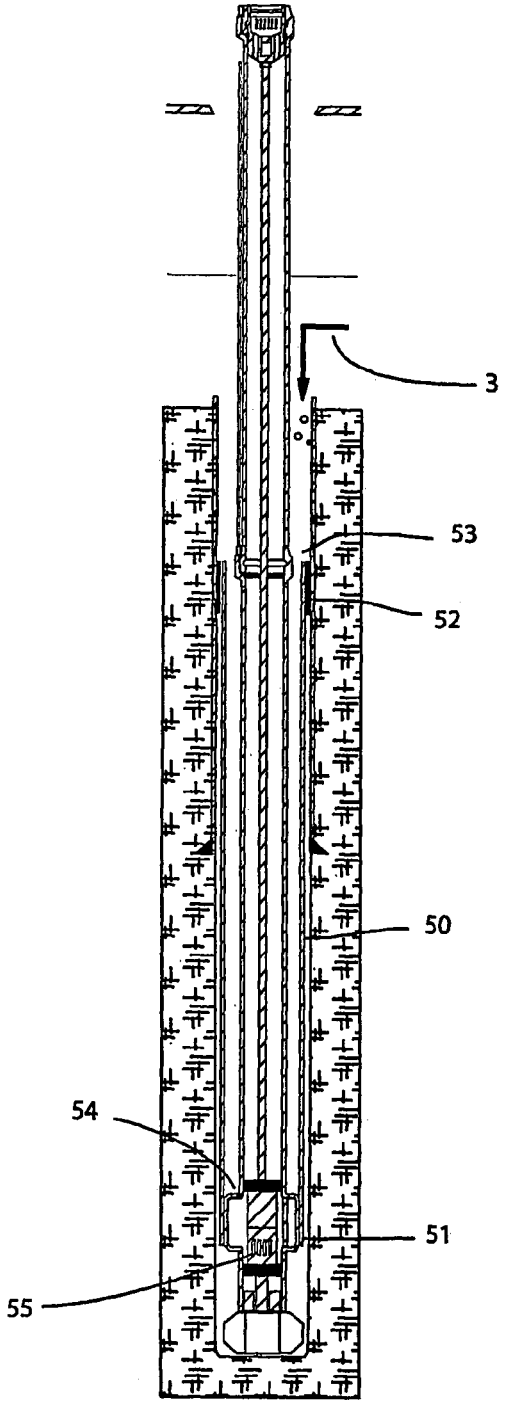
Figure 15:
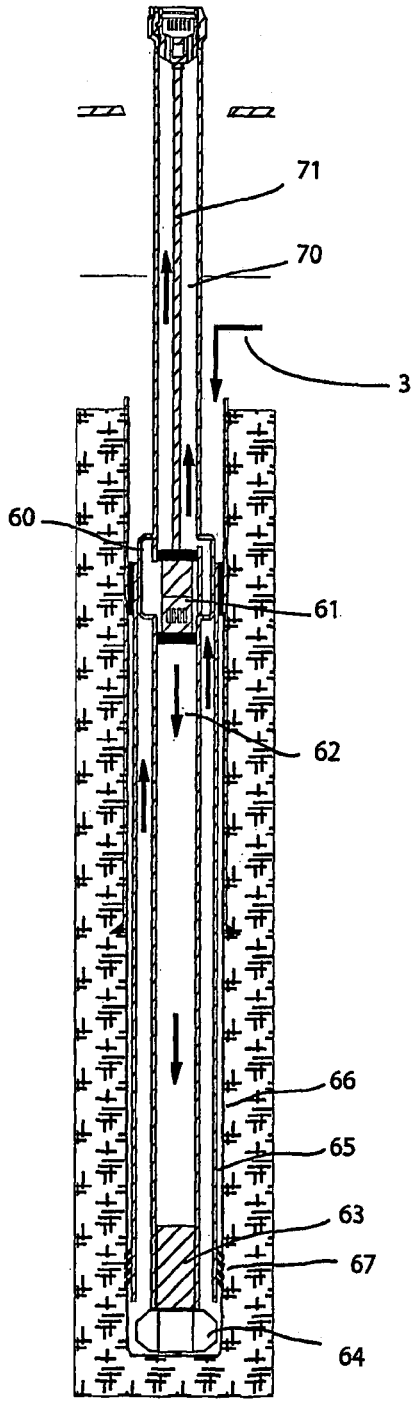

FIGS. 14 and 15 are vertical sections through wells with two further arrangements according to the invention.

Referring to FIGS. 1 to 7 casing 1 has been installed into a borehole 2 and set by in place by cement or other means. New drill pipe 3 or casing is installed to drill the borehole deeper. At the lower end of the drill pipe 3 is a bit 4 and a non return valve (NRV) 5. The NRV 5 is there to prevent a potential flow path to the rig floor for hydrocarbons. Once the bit is at total depth (TD) 6 an electrical cross over sub 7 is installed in the drillpipe at surface. An electrical submersible pump 8 is then lowered inside the drillpipe, it opens the NRV and lands on the bit drive 9. Seals 11 on the ESP are either engaged when it lands or energized when powered up to isolate the pump inlet 12 from the pump outlet 13 up the drillpipe and 14 at the bit nozzles. At surface, the ESP power cable 15 is terminated on a hanger 16 which is described in more detail later. The cross over tool enables new sections of drillpipe to be added 17, while an electrical cable can be banded to the outside of the drillpipe. Clean fluid is fed into the annulus 19, and the ESP displaces wellbore fluid with cuttings back up the drillpipe 20 at a velocity of approximately 1 m/s. It will be appreciated, that as the drillpipe is an enclosed tube, it is much easier to keep cuttings in transport than transport them in an eccentric annulus.

The greatest risk in this system is an electrical fault, either the externally strapped power cable will get damaged, or a problem will occur with the ESP motor. These eventualities have been accommodated as follows.

If there is a fault with the externally strapped cable, a new drillpipe crossover tool 21 can be installed at surface and an internal esp power cable extension 22 can be added. The external power cable is terminated 23 (and is now redundant) The electrical connector 24 includes diodes which disable the now disabled external power cable.

If the problem related to the esp motor, then the hanger 16 can be fished and the entire motor and cable assembly can be recovered, and a new assembly 24 installed. The electrical cross over tool consists of an electrical annular contact 30, which is isolated by seals 31. The esp power cable 15 is terminated onto a hanger. A large flow path exists through the hanger 32 and the hanger locates in a profile 33, using a set of collets. A fishing profile 34 is included to enable a tool to fish the assembly from the well. The external cable 18 is connected to the cross over tool via an electrical socket 35 and this effectively links external cable 18 to esp power cable 15.

Referring to FIGS. 8 to 11 there is shown a side section of the surface cable handling equipment. The wireline 22 is strapped to the outside of the drillpipe 1, at every drillpipe coupling there is a cross coupling protector 40. The wireline reel 41 is mounted on a chassis 42 which allows it to rotate with the drillpipe. The wire is terminated through a slip ring 43 which allows electrical power to be supplied through a stationary wet connect assembly 44 into the rotating reel. When it necessary to add a new joint of drillpipe, the top piece of drillpipe is held in slips on the rig floor. The top joint backs off and is the picked up. The high voltage wet connect 44 allows a simple and unresisted break. The new section of drill pipe 45 is added. Then the wireline reel and slip ring assembly is winched up over the new joint of drillpipe added and the wet electrical connection made.

Referring to FIGS. 12 and 13, there is shown an embodiment of the invention were the drillpipe is not rotated. This is a very straight forward embodiment so the cable is just feed onto the drillpipe as the drillpipe is lowered into the well and drills the well.

Referring to FIG. 14 there is shown a further embodiment for casing while drilling. A section a casing 50 is installed in the well, prior to running the drill pipe of tubing. It is supported/connected to the drillpipe at its lowest most end on a set of dogs, located in the NRV housing. A dynamic seal 52 protects the open hole from debris falling into it and limits the effect of circulating pressures. Fluid supplied to the upper annulus 3, passes between the outside of the drillpipe and the inside of the casing 50, it then passes through ports 54 and feeds the inlet to the ESP pump 55.

Referring to FIG. 15 there is shown a further embodiment of casing drilling. Fluid is supplied into the annulus 3. it the passes into a chamber 60, which is the inlet for the electrical submersible pump 61. The pump is discharged down the central tailpipe extension 62 to a conventional drilling positive displacement motor 63 which turns a retrievable conventional circulation type bit 64. The drill cutting and return fluid are prevented from passing between the outer casing 65 and the drilled borehole 66 by deflectors 67, and the fluid returns up the inside of the casing and outside of the stinger tube 68. The fluid passes by the esp 61 and flows back to surface within the drillpipe 70, around the electrical umbilical 71. In this variation, conventional drilling assembly is employed, while gaining a significant benefit of reverse circulation.

The invention claimed is:

1. A drilling system for use in a well bore consisting of
- a drill string,
- an electrically powerable pump recoverable through the drill string,
- a connector for supporting the pump including a through bore through which fluid can flow, and
- a power cable to provide power to the electrically powerable pump.

2. A system according to claim 1 wherein cuttings are pumped up through the drill pipe.

3. A system according to claim 1 wherein a drill bit is powered by the pump.

4. A system according to claim 1 wherein the electrically powerable pump is recoverable by winching an internal cable attached to the connector.

5. A system according to claim 1 wherein the drill string includes a check valve beneath the electrically powerable pump.

6. A system according to claim 1 wherein a drill bit is powered by the cable.

7. A system according to claim 1 wherein telemetry data is carried on the power cable.

8. A drilling system for use in a well bore consisting of
- a drill string having a cross-over below where new pipe sections are added to the drill string,
- an electrically powerable pump,
- a connector for supporting the pump including a through bore through which fluid can flow, and
- a power cable to provide power to the electrically powerable pump and having a part outside the cable above the cross over, the cable extending through the crossover and thence in the drill string to the pump.

* * * * *